US007440874B2

(12) United States Patent
Durney et al.

(10) Patent No.: US 7,440,874 B2
(45) Date of Patent: Oct. 21, 2008

(54) METHOD OF DESIGNING FOLD LINES IN SHEET MATERIAL

(75) Inventors: Max W. Durney, San Francisco, CA (US); Alan D. Pendley, Petaluma, CA (US)

(73) Assignee: Industrial Origami, Inc., San Francisco, CA (US)

( * ) Notice: Subject to any disclaimer, the term of this patent is extended or adjusted under 35 U.S.C. 154(b) by 594 days.

(21) Appl. No.: 10/821,818

(22) Filed: Apr. 8, 2004

(65) Prior Publication Data

US 2005/0005670 A1 Jan. 13, 2005

Related U.S. Application Data

(63) Continuation-in-part of application No. 10/795,077, filed on Mar. 3, 2004, now Pat. No. 7,152,450, which is a continuation-in-part of application No. 10/672,766, filed on Sep. 26, 2003, now Pat. No. 7,152,449, which is a continuation-in-part of application No. 10/256,870, filed on Sep. 26, 2002, now Pat. No. 6,877,349, which is a continuation-in-part of application No. 09/640,267, filed on Aug. 17, 2000, now Pat. No. 6,481,259.

(51) Int. Cl.
*G06F 17/50* (2006.01)
*B21D 28/00* (2006.01)

(52) U.S. Cl. ..... 703/1; 703/2; 72/324; 72/379.2

(58) Field of Classification Search ..... 703/1, 703/2, 6; 700/159, 182; 72/379.2, 324, 335, 72/129, 185; 425/136; 52/658; 493/399, 493/363, 596, 352, 356, 361

See application file for complete search history.

(56) References Cited

U.S. PATENT DOCUMENTS

| | | | |
|---|---|---|---|
| 975,121 | A | 11/1910 | Carter |
| 1,295,769 | A | 2/1919 | Kux |
| 1,405,042 | A | 1/1922 | Kraft |
| 1,698,891 | A | 1/1929 | Overbury |
| 2,127,618 | A | 8/1938 | Riemenschneider |

(Continued)

FOREIGN PATENT DOCUMENTS

DE 298 18 909 U1 2/1999

(Continued)

OTHER PUBLICATIONS

U.S. Appl. No. 09/492,994.*

(Continued)

*Primary Examiner*—Russell Frejd
(74) *Attorney, Agent, or Firm*—Morgan, Lewis & Bockius LLP; David J. Brezner; Victor E. Johnson

(57) ABSTRACT

A method includes defining a desired fold line in sheet material and populating the fold line with a fold geometry including cut zones that define connected zones, whereby upon folding the material produces edge-to-face engagement of the material on opposite sides of the cut zones. Alternatively, the method includes storing cut zone configurations and connected zone configurations, defining a desired fold line, selecting a cut zone and/or a connected zone, locating a preferred fold geometry, including the cut zone and the connected zone, along the fold line, and relocating, rescaling and/or reshaping the preferred fold geometry to displace, add and/or subtract at least one of the connected zones, whereby upon folding the material produces edge-to-face engagement of the material on opposite sides of the cut zones. Also, a computer program product and a system configured for implementing the method.

40 Claims, 7 Drawing Sheets

U.S. PATENT DOCUMENTS

| | | | | |
|---|---|---|---|---|
| 2,560,786 | A | 7/1951 | Wright et al. | |
| 2,976,747 | A | 3/1961 | Schatzschock et al. | |
| 3,228,710 | A | 1/1966 | Chodorowski | |
| 3,258,380 | A | 6/1966 | Fischer et al. | |
| 3,341,395 | A | 9/1967 | Weber | |
| 3,353,639 | A | 11/1967 | Andriussi | |
| 3,756,499 | A | 9/1973 | Giebel et al. | |
| 3,788,934 | A | 1/1974 | Coppa | |
| 3,854,859 | A | 12/1974 | Sola | |
| 3,938,657 | A | 2/1976 | David | |
| 3,963,170 | A | 6/1976 | Wood | |
| 4,215,194 | A | 7/1980 | Sheperd | |
| 4,289,290 | A | 9/1981 | Miller | |
| 4,559,259 | A | 12/1985 | Cetrelli | |
| 4,659,259 | A | 12/1985 | Cetrelli | |
| 4,628,661 | A | 12/1986 | St. Louis | |
| 4,837,066 | A | 6/1989 | Quinn et al. | |
| 4,951,967 | A | 8/1990 | Michalik | |
| 5,148,600 | A | 9/1992 | Mohan | |
| 5,148,900 | A | 9/1992 | Mohan | |
| 5,157,852 | A | 10/1992 | Patrou et al. | |
| 5,205,476 | A * | 4/1993 | Sorenson | 229/114 |
| 5,225,799 | A | 7/1993 | West et al. | |
| 5,239,741 | A | 8/1993 | Shamos | |
| 5,390,782 | A | 2/1995 | Sinn | |
| 5,524,396 | A | 6/1996 | Lalvani | |
| 5,568,680 | A | 10/1996 | Parker | |
| 5,587,914 | A * | 12/1996 | Conradson et al. | 700/95 |
| 5,692,672 | A | 12/1997 | Hunt | |
| 5,701,780 | A | 12/1997 | Ver Meer | |
| 5,709,913 | A | 1/1998 | Anderson et al. | |
| 5,789,050 | A | 8/1998 | Kang | |
| 5,828,575 | A | 10/1998 | Sakai | |
| 5,885,676 | A | 3/1999 | Lobo et al. | |
| 6,132,349 | A | 10/2000 | Yokoyama | |
| 6,144,896 | A | 11/2000 | Kask et al. | |
| 6,210,037 | B1 | 4/2001 | Brandon, Jr. | |
| 6,233,538 | B1 * | 5/2001 | Gupta et al. | 703/6 |
| 6,412,325 | B1 | 7/2002 | Croswell | |
| 6,481,259 | B1 | 11/2002 | Durney | |
| 6,490,498 | B1 * | 12/2002 | Takagi | 700/159 |
| 6,599,601 | B2 | 7/2003 | Fogle et al. | |
| 6,640,605 | B2 * | 11/2003 | Gitlin et al. | 72/379.2 |
| 6,643,561 | B1 | 11/2003 | Torvinen | |
| 6,658,316 | B1 | 12/2003 | Mehta et al. | |
| 6,877,349 | B2 | 4/2005 | Durney et al. | |
| 7,032,426 | B2 | 4/2006 | Durney et al. | |
| 7,152,449 | B2 | 12/2006 | Durney | |
| 7,152,450 | B2 | 12/2006 | Durney et al. | |
| 7,374,810 | B2 | 5/2008 | Durney et al. | |
| 2001/0010167 | A1 | 8/2001 | Leek | |
| 2002/0184936 | A1 | 12/2002 | Gitlin et al. | |
| 2003/0037586 | A1 | 2/2003 | Durney et al. | |
| 2004/0134250 | A1 | 7/2004 | Durney et al. | |
| 2004/0206152 | A1 | 10/2004 | Durney et al. | |
| 2005/0005670 | A1 | 1/2005 | Durney et al. | |
| 2005/0061049 | A1 | 3/2005 | Durney et al. | |
| 2005/0064138 | A1 | 3/2005 | Durney et al. | |
| 2005/0097937 | A1 | 5/2005 | Durney et al. | |
| 2005/0126110 | A1 | 6/2005 | Durney et al. | |
| 2007/0113614 | A1 | 5/2007 | Durney et al. | |

FOREIGN PATENT DOCUMENTS

| | | | |
|---|---|---|---|
| GB | 2 129 339 | A | 5/1984 |
| JP | 52-068848 | | 6/1977 |
| JP | 53-070069 | | 6/1978 |
| JP | 55-022468 | | 2/1980 |
| JP | 55-055222 | | 4/1980 |
| JP | 59-006116 | | 1/1984 |
| JP | 02-065416 | | 5/1990 |
| JP | 02-065416 | U | 5/1990 |
| JP | 02-165817 | | 6/1990 |
| JP | 02-192821 | | 7/1990 |
| JP | 02-258116 | | 10/1990 |
| JP | 04-033723 | | 2/1992 |
| JP | 04-091822 | | 3/1992 |
| JP | 05-261442 | | 10/1993 |
| JP | 06-261442 | | 10/1993 |
| JP | 07-148528 | | 6/1995 |
| JP | 08-224619 | | 9/1996 |
| JP | 10-085837 | | 4/1998 |
| JP | 11-123458 | | 5/1999 |
| JP | 11-188426 | | 7/1999 |
| WO | WO 97/24221 | | 7/1997 |
| WO | WO 97/24221 | A1 | 7/1997 |
| WO | WO 02/13991 | A1 | 2/2002 |
| WO | WO 2005/082112 | A | 9/2005 |
| WO | WO 2005/099925 | A | 10/2005 |

OTHER PUBLICATIONS

Derwent Abstract Accession No. 1995-280162/37, M21, JP 3474242, Dec. 8, 2003 (Amada Co. Ltd).

Derwent Abstract Accession No. 1999-340844/29, P52, JP 11-123458 A, May 11, 1999 (Meiji Nat Kogyo KK).

Derwent Abstract Accession No. 80-C6243C/12, FR2428372 A, Feb. 8, 1980 (Merlin & Gerin).

Derwent Abstract Accession No. 83-G2401K/19, FR 2514103 A, Apr. 8, 1983 (Grun).

Derwent Abstract Accession No. 97-345802/32, P52, JP 9 141333 A, Jun. 3, 1997 (Kokusai Denki KK).

Derwent Abstract Accession No. 98-265616/24, P52, JP 10-085837 A, Apr. 7, 1998 (Mitsubishi Electric Corp).

Derwent Abstract Accession No. 99-062297/06, P52, DE 29818909 U, Dec. 24, 1998 (Fortmeier).

*EasyBend™—Complex Bending Made Easy*, ©2004 Mate Precision Tooling Inc., Anoka, Minnesota.

Patent Abstracts of Japan, vol. 004, No. 053 (M-008), Apr. 19, 1980 (JP 55-022468 A).

Patent Abstracts of Japan, vol. 015, No. 006 (M-1066), Jan. 8, 1991 (JP 02-258116 A).

Publication "Office dA" by Contemporary World Architects, 2000, pp. 15, 20-35, Rockport Publishers, Inc., Gloucester, Massachusetts.

* cited by examiner

FOLDS, HIGH AND LOW FATIGUE

METHOD OF DESIGNING FOLD LINES IN SHEET MATERIAL

RELATED APPLICATIONS

This application is a Continuation-in-Part of U.S. patent application Ser. No. 10/795,077, filed Mar. 3, 2004 and entitled SHEET MATERIAL WITH BEND CONTROLLING DISPLACEMENTS AND METHOD FOR FORMING THE SAME and now U.S. Pat. No. 7,152,450, which is a Continuation-in-Part of U.S. patent application Ser. No. 10/672,766, filed Sep. 26, 2003 and entitled TECHNIQUES FOR DESIGNING AND MANUFACTURING PRECISION-FOLDED, HIGH STRENGTH, FATIGUE-RESISTANT STRUCTURES AND SHEET THEREFOR and now U.S. Pat. No. 7,152,449, which is a Continuation-in-Part of U.S. patent application Ser. No. 10/256,870, filed Sep. 26, 2002 and entitled METHOD FOR PRECISION BENDING OF SHEET MATERIALS, SLIT SHEET AND FABRICATION PROCESS and now U.S. Pat. No. 6,877,349, which is a Continuation-in-Part of U.S. patent application Ser. No. 09/640,267, filed Aug. 17, 2000 and entitled METHOD FOR PRECISION BENDING OF A SHEET OF MATERIAL AND SLIT SHEET THEREFOR and now U.S. Pat. No. 6,481,259, the entire contents of which applications is incorporated herein by this reference.

BACKGROUND OF THE INVENTION

1. Field of the Invention

This invention relates, in general, to technology for designing fold lines in sheet material and more particularly to a method, a computer program product and a method for designing fold lines in sheet material.

2. Description of Related Art

A commonly encountered problem in connection with bending sheet material is that the locations of the bends are difficult to control because of bending tolerance variations and the accumulation of tolerance errors. For example, in the formation of the housings for electronic equipment, sheet metal is bent along a first bend line within certain tolerances. The second bend, however, often is positioned based upon the first bend, and accordingly, the tolerance errors can accumulate. Since there can be three or more bends which are involved to create the chassis or enclosure for the electronic components, the effect of cumulative tolerance errors in bending can be significant. Moreover, the tolerances that are achievable will vary widely depending on the bending equipment, and its tooling, as well as the skill of the operator. The problem of controlling the positioning of bend lines, of course, can occur in connection with may other three-dimensional products.

One approach to this problem has been to try to control the location of bends in sheet material through the use of slitting or grooving. Slits and grooves can be formed in sheet stock very precisely, for example, by the use of computer numerically controlled (CNC) devices which control a slit or groove forming apparatus, such as a laser, a water-jet cutting apparatus, a punch press, a knife or other tool. Such slits and grooves have been used in prior systems as a basis for bending sheet material. For example, U.S. Pat. No. 6,640,605 to Gitlin et al. describes a method of bending sheet metal to form three-dimensional structures. The bend forming techniques of such prior slitting-based systems may, however, significantly weaken the resulting structure.

Industrial Origami, Inc. (IOI), the assignee of the present invention, is presently developing new and improved approaches to overcome the disadvantages of prior sheet material bending systems. Namely, by providing sheet materials with new and improved slit configurations, IOI has developed an approach that allows bending of the sheet material along a fold line that results in a three-dimensional structure having edge-to-face engagement along the fold line. Such edge-to-face engagement greatly increases the strength of the resultant three-dimensional product compared with prior art slitting methods. Additionally, IOI's new slit-based bending designs result in structures that may be more rigid than traditionally bent structures that are un-slit. Furthermore, IOI's new and improved slit designs advantageously reduce stress concentrations in the three-dimensional structure along the fold lines.

While it is possible to draw IOI's new and improved slit configurations with the standard sketch tools of conventional computer-aided design (CAD) systems, a CAD user may find that drawing, locating, scaling and shaping individual compound-shaped slits that constitute IOI's slit configurations rather repetitive and challenging. What is needed is a method, computer program product and system that is able to readily allow a CAD designer to determine an improved fold geometry based on IOI's new and improved slit configurations and efficiently apply such fold geometry to a sheet material design.

BRIEF SUMMARY OF THE INVENTION

In summary, one aspect of the present invention is directed to a method of designing a desired fold line for a sheet of material including the steps of defining the desired fold line in a parent plane on a drawing system; and populating the fold line with a fold geometry including a series of cut zones that define a series of connected zones configured and positioned relative to the fold line whereby upon folding the material along the fold line produces edge-to-face engagement and support of the material on opposite sides of the cut zones.

The method may further include locating, scaling and/or shaping the cut zones to define the connected zones that are along the fold line so as to enable the edge-to-face engagement and support upon folding of a non-crushable sheet of material along the fold line. The method may further include relocating, rescaling and/or reshaping at least one of the cut zones to displace, add and/or subtract at least one of the connected zones. The method may further include detecting weaknesses in the parent plane, and relocating, rescaling and/or reshaping at least one of the connected zones to displace, add and/or subtract at least one of the connected zones based on localized fold geometry adjacent the weaknesses. The populating step may define the cut zones and connected zones to resist stress concentration, fatigue and fracture initiation upon folding the material along the fold line.

The method may further include defining the fold geometry based upon at least one parameter selected from the group of: type of material, material thickness, strap width, strap density, kerf, fatigue strength, and angle of material orientation. The method may be implemented as an adjunct to a CAD/CAM system having fold and unfold capabilities. The method may further include providing a visualization on the CAD/CAM system that displays the cut zone and the connected zone geometry as populated along the fold line. Alternatively, the method may be implemented integral with a CAD/CAM system having fold and unfold capabilities. The method may further include designing a creased sheet-material product including creased features, wherein the cut zones and the connected zones are superimposed upon the creased features.

Another aspect of the present invention is directed to a method of designing a desired fold line for a non-crushable sheet of material including the steps of storing a plurality of cut zone configurations and connected zone configurations having differing dimensions and/or shapes, defining a desired fold line in a parent plane on a drawing system, selecting a preferred cut zone and/or a preferred connected zone which have a desired shape and scale, locating a preferred fold geometry along the fold line, the preferred fold geometry including the selected cut zone and the selected connected zone, and relocating, rescaling and/or reshaping the preferred fold geometry to displace, add and/or subtract at least one of the connected zones, whereby upon folding the material along the fold line, the method produces edge-to-face engagement and support of the material on opposite sides of the cut zones.

The method may further include providing a fastening mechanism for permitting connection of a first plane of the material with a second plane of the material lapped with the first plane in association with the fold line. The fastening mechanism may be selected from the group of aligned holes, tabs, slots and combination thereof.

Yet another aspect of the present invention is directed to a computer program product in a computer-readable medium for use in a data processing system for designing a desired fold line for a sheet of material. The computer program product includes instructions for defining the desired fold line in a parent plane on a drawing system, and instructions for populating the fold line with a fold geometry including a series of cut zones that define a series of connected zones configured and positioned relative to the fold line whereby upon folding the material along the fold line produces edge-to-face engagement and support of the material on opposite sides of the cut zones.

The computer program product may further include instructions for locating, scaling and/or shaping the cut zones to define the connected zones that are along the fold line so as to enable the edge-to-face engagement and support upon folding of the material along the fold line. The computer program product may further include instructions for relocating, rescaling and/or reshaping at least one of the cut zones to displace, add and/or subtract at least one of the connected zones. The computer program product may further include instructions for detecting weaknesses in the parent plane, and instructions for relocating, rescaling and/or reshaping at least one of the connected zones to displace, add and/or subtract at least one of the connected zones based on localized fold geometry adjacent the weaknesses. The instructions for populating may define the cut zones and connected zones to resist stress concentration and fracture initiation upon folding the material along the fold line.

The computer program product may further include instructions for defining the fold geometry based upon at least one parameter selected from the group of: type of material, material thickness, strap width, strap density, kerf, fatigue strength, and angle of material orientation. The computer program product may be configured for installation with a CAD/CAM system having fold and unfold capabilities. The computer program product may further include instructions for providing a visualization or display on the CAD/CAM system that illustrates the cut zone and the connected zone geometry as populated along the fold line. The computer program product may include a CAD/CAM application having fold and unfold capabilities. The computer program product may further include instructions for designing a creased sheet-material product including creased features, wherein the cut zones and the connected zones are superimposed upon desired creased features.

A further aspect of the present invention is directed to a computer program product in a computer-readable medium for use in a data processing system for designing a desired fold line for a non-crushable sheet of material, the computer program product including instructions for storing a plurality of cut zone configurations and connected zone configurations having differing dimensions and/or shapes, instructions for defining a desired fold line in a parent plane on a drawing system, instructions for selecting a preferred cut zone and/or a preferred connected zone which have a desired shape and scale, instructions for locating a preferred fold geometry along the fold line, the preferred fold geometry including the selected cut zone and the selected connected zone, and instructions for relocating, rescaling and/or reshaping the preferred fold geometry to displace, add and/or subtract at least one of the connected zones, whereby upon folding the material along the fold line produces edge-to-face engagement of the material on opposite sides of the cut zones.

The computer program product may further include instructions for providing a fastening mechanism for permitting connection of a first plane of the material with a second plane lapped with the first plane in association with the fold line. The fastening mechanism may be selected from the group of: aligned holes, tabs, slots and combination thereof.

Yet a further aspect of the present invention is directed to a data processing system for designing a desired fold line for a non-crushable sheet of material including, input means for defining the desired fold line in a parent plane on a drawing system, and computing means for populating the fold line with a fold geometry including a series of cut zones that define a series of connected zones configured and positioned relative to the fold line whereby upon folding the material along the fold line produces edge-to-face engagement of the material on opposite sides of the cut zones.

The computing means may locate, scale and/or shape the cut zones to define the connected zones that are along the fold line so as to enable the edge-to-face engagement upon folding of the material along the fold line. The computing means may relocate, rescale and/or reshape at least one of the cut zones to displace, add and/or subtract at least one of the connected zones. The computing means may detect weaknesses in the parent plane and relocate, rescale and/or reshape at least one of the connected zones to displace, add and/or subtract at least one of the connected zones based on localized fold geometry adjacent the weaknesses. The computing means may define the cut zones and connected zones to resist stress concentration and fracture initiation upon folding the material along the fold line. The computing means may define the fold geometry based upon at least one parameter selected from the group of: material type, material thickness, strap width, strap density, kerf, fatigue strength, and angle of material orientation.

The system may further include memory means storing a plurality of predetermined fold geometries based upon at least one parameter selected from the group of: material type, material thickness, strap width, strap density, kerf, fatigue strength, and angle of material orientation, wherein the computing means selects one of the predetermined fold geometries. The system may further include a CAD/CAM system having fold and unfold capabilities. The system may further include display means for providing a visualization on the CAD/CAM system that displays the cut zones and the connected zones geometry as populated along the fold line. The system may be used in combination with a CAD/CAM system having fold and unfold capabilities. The system may be configured for designing a creased sheet-material product including creased features, wherein the computing means superimposes the cut zones and the connected zones upon the creased features.

Further still, another aspect of the present invention is directed to a system for designing a desired fold line for a non-crushable sheet of material including storage means for storing a plurality of cut zone configurations and connected zone configurations having differing dimensions and/or shapes, input means for defining a desired fold line in a parent plane on a drawing system, computing means for selecting a preferred cut zone and/or a preferred connected zone which have a desired shape and scale, wherein the computing means locates a preferred fold geometry along the fold line, the preferred fold geometry including the selected cut zone and the selected connected zone, and wherein the computing means relocates, rescales and/or reshapes the preferred fold geometry to displace, add and/or subtract at least one of the connected zones, whereby upon folding the material along the fold line produces edge-to-face engagement of the material on opposite sides of the cut zones.

The computing means may be configured to design and/or form a fastening mechanism for permitting connection of a first plane of the material with a second plane of the material lapped with the first plane in association with the fold line. The fastening mechanism may be selected from the group of: aligned holes, tabs, slots and combination thereof.

The method of designing fold lines in sheet material of the present invention has other features and advantages which will be apparent from or are set forth in more detail in the accompanying drawings, which are incorporated in and form a part of this specification, and the following Detailed Description of the Invention, which together serve to explain the principles of the present invention.

DETAILED DESCRIPTION OF THE INVENTION

Figure 1:
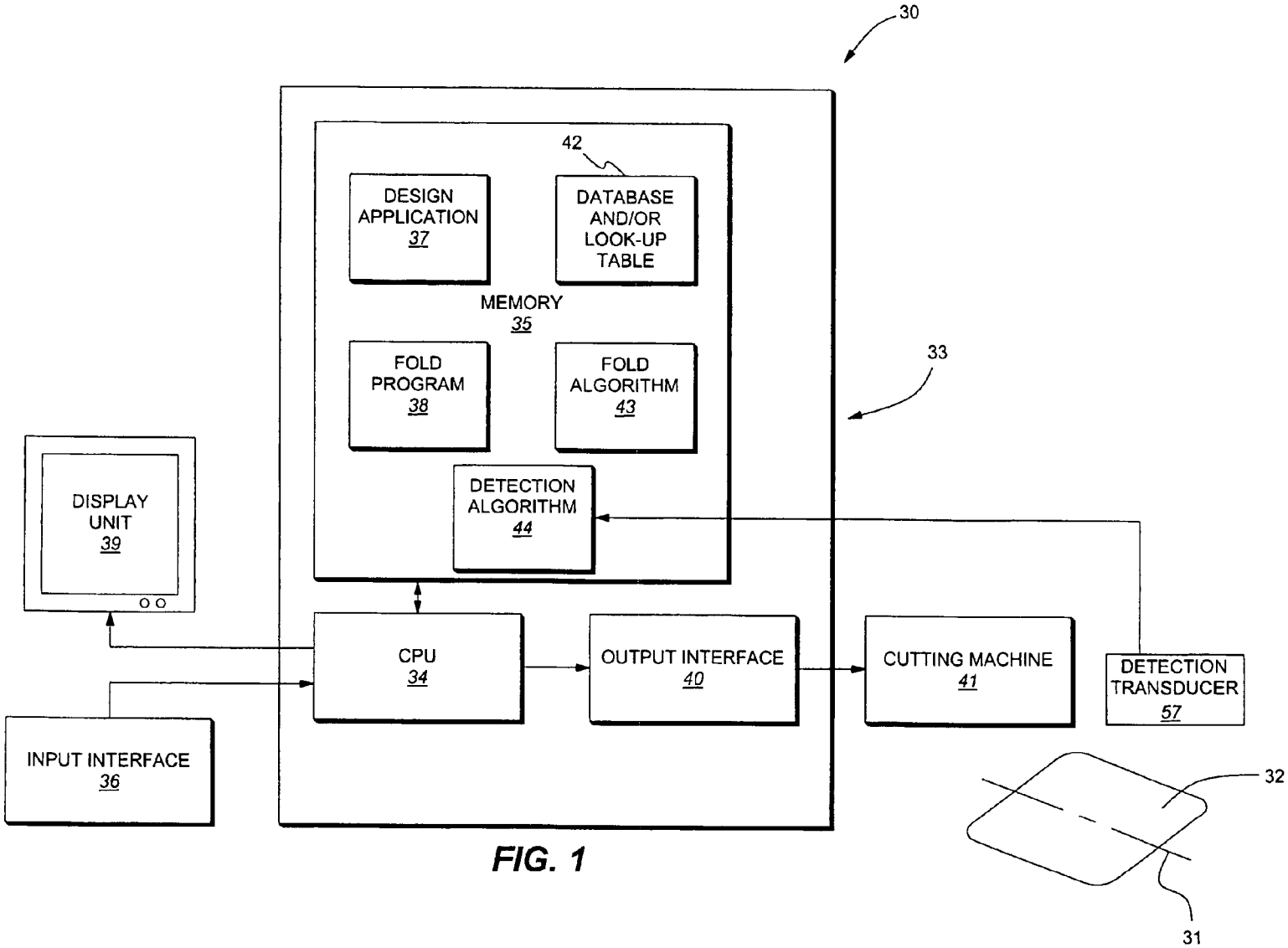
FIG. 1 is a block diagram that illustrates aspects of an exemplary system of the present invention for designing fold lines in accordance with the present invention.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

The present invention is directed to methods, computer program products and systems for designing one or more desired fold lines for a non-crushable sheet of material utilizing various fold geometries and configurations including, but not limited to, those disclosed by U.S. patent application Ser. No. 09/640,267, filed August filed Aug. 17, 2000, entitled METHOD FOR PRECISION BENDING OF A SHEET OF MATERIAL AND SLIT SHEET THEREFOR and now U.S. Pat. No. 6,481,259 ('259 patent), U.S. patent application Ser. No. 10/256,870 ('870 application), filed Sep. 26, 2002 and entitled METHOD FOR PRECISION BENDING OF SHEET OF MATERIALS, SLIT SHEETS AND FABRICATION PROCESS and now U.S. Pat. No. 6,877,349, U.S. patent application Ser. No. 10/672,766 ('766 application), filed Sep. 26, 2003 and entitled TECHNIQUES FOR DESIGNING AND MANUFACTURING PRECISION-FOLDED, HIGH STRENGTH, FATIGUE-RESISTANT STRUCTURES AND SHEET THEREFOR and now U.S. Pat. No.7,152,449, and U.S. Pat. No. 10/795,077, filed Mar. 3, 2004 and entitled SHEET MATERIAL WITH BEND CONTROLLING DISPLACEMENTS AND METHOD FOR FORMING THE SAME and now U.S. Pat. No.7,152,450, the entire contents of which patent and patent applications are incorporated herein by this reference.

Advantageously, the present invention is directed to technology that enables the transfer of high accuracy two-dimensional (2D) computer numerical control (CNC) cutting technology to a highly accurate three-dimensional (3D) folded structure, such as those disclosed by the above-mentioned '259 patent and as well as the '870 and '766 applications. In particular, the present invention utilizes parametric programming to determine a preferred fold-enabling or fold-facilitating "fold geometry", that is, a geometric configuration including a series of curved slits or cut zones that are arranged on either side of a desired fold line which enables or facilitates bending a sheet of material along the desired fold line. One will appreciate that parametric programming generally refers to programming for solving an optimization problem for a range of parameters.

Generally, a "fold line" is the line or axis extending along a sheet of material or "parent plane" about which a class of bend, similar to that produced by a press brake or a leaf brake, is formed or extends. For example, a desired fold line is the imaginary line that extends through the sheet of material and, upon forming the desired bend, is substantially coincident with the vertex of the fold or bend. One will appreciate that a fold line may be straight or slightly curved. A "parent plane" is the plane of sheet material from which engineered folds of the present invention are slit, cast or otherwise formed in an additive or subtractive manner to facilitate bending about the fold line. One will appreciate that the term "creased features" may be used to generally refer to geometric features including, but not limited to, folds, bends, creases, ridges, and other desired geometric configurations to be formed about the fold line.

For the purpose of the present invention, the terms "curved slit" refers to a slit that is formed by at least one non-linear geometric shape. For example, a curved slit may be in the form of an elongated slit having a linear portion and a circular portion, such as that disclosed by the '259 patent, a compound curve having a larger-radii central portion and smaller-radii end portions such as those described by the '870 and '766 applications, and/or other suitable non-linear geometries. The term "cut zone" shall include curved slots as well as slits comprised of all linear segments. A series of two, three, four or more cut zones define a corresponding "series" of one, two, three or more connected zones namely, the portion(s) of material disposed between adjacent cut zones.

For the purpose of the present invention, the term "strap" refers to the connected zones that are disposed between the cut zones and interconnect first and second planar portions of the sheet material on either side of the fold line, which first and second planar portions will be angularly disposed in a dihedral angle with respect to one another once the sheet is folded along the fold line. As discussed in greater detail below, and as disclosed by the '259 patent and the '870 and '766 applications, the slit/strap configuration formed by the method of the present invention provides for edge-to-face engagement and support of the first and second planar portions during and upon bending of the sheet of material about the fold line.

By utilizing parametric programming, the present invention may be used to readily generate one or more fold geometries in which a computer application automatically determines the scale and position of one or more predefined cut zones about a desired fold line in a specific sheet of material instead of having to write a new set of instructions, or a new program, for each specific sheet. In particular, parametric programming may be utilized to allow a user such as a designer, engineer or computer numerically controlled (CNC) programmer to vary the parameters of a particular task, that is, determine the fold geometry for a fold line of a specific sheet of material based upon the specific characteristics or parameters of the specific sheet, the capabilities of the available cutting apparatus, and the required or desired performance criteria for the resulting folded sheet. Such characteristics may include, but are not limited to: the type of material of the sheet, the dimensions of the sheet such as length, width and thickness, the desired shape dimensions of the strap, such as length, width and thickness; the desired spacing of the strap; the desired kerf; the orientation of cut zones; the edge orientation of the sheet at the termini of the fold line; the vector of material orientation relative to the fold when the folding properties of the material are anisotropic, whether holes, slots, grooves, deformities, and/or other local geometric deviations are found in the sheet; the cutting capabilities of the slitting apparatus and their affect on the cost of the resulting folded sheet; and/or the performance criteria of the folded sheet.

A computer program product in accordance with the present invention may store predefined fold geometries that may be relocated, rescaled, reshaped, and/or otherwise modified based upon the characteristics of a specific sheet of material. Alternatively, the computer program product may comprise one or more algorithms that determine fold geometries and/or relocate, rescale, reshape and/or otherwise modify a fold geometry based upon the characteristics of the specific sheet. Further still, the computer program product may utilize a combination of predefined fold geometries and algorithms to determine the fold geometry. A user may utilize the computer application to determine a preferred fold geometry for a multitude of different sheets by simply inputting various characteristics of the sheet. Accordingly, the user is not required to design the location, scale and shape of each cut zone and connecting zone thus saving considerable time and effort on the part of the user.

Such computer program product may be integrated with and/or used in combination with existing computer-aided design (CAD) applications, computer-aided engineering (CAE), computer-aided manufacturing (CAM) applications and/or combinations thereof (collectively referred to as "design applications"). For example, a computer program product in accordance with the present invention may be implemented as an adjunct (e.g., a plug-in) to existing modeling applications, such as the SOLIDWORKS® 2004 application sold by the SolidWorks Corporation of Concord, Mass., the SOLID EDGE® application by Intergraph Corporation of Huntsville, Ala., the CATIA® application sold by Dassault Systems Corporation of Suresnes, France, and/or the PRO/ENGINEER® application by Parametric Technology Corporation of Waltham, Mass. Alternatively, the computer program product may be integrated into any one or more of a CAD application, CAE application and a CAM application. One will further appreciate that the computer program product may be configured as a stand-alone program.

Turning now to the drawings, wherein like components are designated by like reference numerals throughout the various figures, attention is directed to FIG. 1, which figure illustrates a block diagram of a system 30 for designing a desired fold line 31 in a sheet 32 of material in accordance with the present invention. The system includes a computer 33 having a central processing unit (CPU) 34 or other suitable means for performing basic system level procedures, manage data storage and manage executing application procedures. The computer also includes a memory source 35 that is addressable by the CPU. The memory source may include any combination of storage that is internal or external to the CPU and may include, but is not limited to, cache memory, random access memory (RAM), and/or external virtual memory on a data storage device.

The CPU is connected to a user input interface 36 such as a keyboard, touch screen or other suitable means that allows a user to input the particular characteristics of a specific sheet 32.

The computer includes a suitable drawing system or design application 37 which allows electronic modeling of sheet 32 in a well-known manner, for example, by solid modeling, wire-frame modeling, and/or other suitable means. One will appreciate that design application 37 may be one or more of the above-mentioned existing CAD/CAE/CAM applications or other suitable design application that is loaded on computer 33 and stored in memory 35 in a well-known manner. Preferably, design application 37 includes one or more well-known tools which allow a user to electronically manipulate the electronic modeling of sheet 32. For example, the design application may include various design analysis tools, such as finite element analysis, that allow the user to electronically simulate or "virtually" test the electronic modeling for stress, strain, displacement, and other properties in well-known manner. In particular, the design application preferably includes fold and/or bend capabilities, that is, a tool that allows the user to electronically simulate folding or bending of sheet material along a fold line.

In accordance with the present invention, computer 33 is also provided with an additional program, namely a fold program 38 that includes parametric programming that is configured to determine the preferred fold geometry based upon the specific characteristics or parameters of sheet 32. Fold program 38 may store predefined fold geometries that may be modified and/or include algorithms to determined the preferred fold geometry as noted above and described in greater detail below.

The CPU is connected to a display unit 39 such as a monitor or other suitable means, which display unit allows display of a simulated visualization of the sheet and corresponding characteristics, simulated visualization of one or more preferred fold geometries as applied to the sheet, and/or the product resulting from bending the sheet along the fold line, among other possibilities.

The CPU may also be connected to a device output interface 40 which, in turn, is connected to a cutting machine 41 that is configured to apply the cut zones producing the fold geometry to the sheet. For example, output interface may be configured to transfer the fold geometry to a CNC cutting machine or other suitable device in a format that is readable by the cutting machine. Preferably, the format that transfers the fold geometry instructions to the cutting machine does not require further intervention by the cutting machine. One will appreciate that the instructions may be transferred in the form of various well-known formats including, but not limited to, .MDF, .DXF, .IGES, and/or .STEP files.

Figure 2:
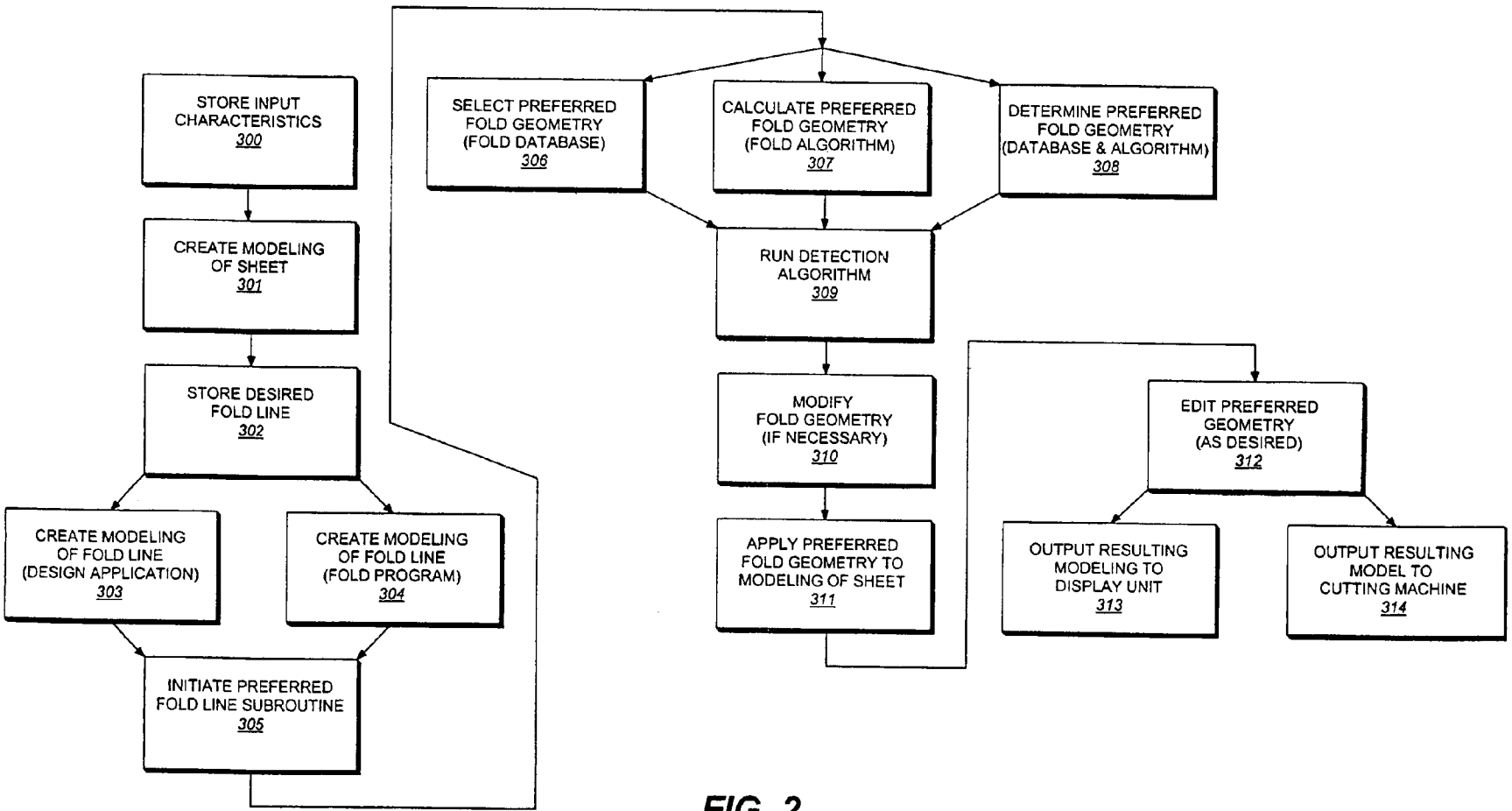
FIG. 2 is a block diagram that illustrates aspects of an exemplary procedure or method of the present invention for designing fold lines in accordance with the present invention.

Turning now to FIG. 2, an exemplary method for designing fold lines in accordance with the present invention is schematically illustrated. One will appreciate that system 30 may be utilized to implement the methods of the present invention. One will also appreciate that a computer program product including the instructions of the fold program 38 may be loaded on an existing computer or computer network in order to implement the methods of the present invention.

A user may input various characteristics or parameters of sheet of material 32 and/or the cutting apparatus and/or the strength requirements of the folded sheet into the system utilizing keyboard 36 (step 300). For example, the user may input the type of material, the dimensions of the sheet including the thickness, and other relevant parameters describing the physical properties of the sheet. One will appreciate that the system may be configured to automatically determine certain physical characteristics of the sheet by scanning and/or other suitable means. The design application will create an electronic modeling of sheet 32 in a well-known manner (step 301).

The user then enters the desired fold line (step 302). Namely, the user enters the desired characteristics of fold line 31 including position, shape, length, and/or other desired parameters. In the event that the design application has embedded or integral fold and unfold capabilities, the design application will create an electronic modeling of the fold line (step 303). Alternatively, an external fold program may generate the electronic modeling of the fold line (step 304).

The user can also input the type of cut zone forming or cutting apparatus to be employed so that any cutting limitations can be considered when designing the cut zones. For example, CNC cutting machines may be capable of cuts that punch presses or slitting knives are not capable of performing.

Finally, performance parameters of the folded sheet, such as strength, fatigue resistance, and/or cost limitations, can be entered.

In many cases, these various data entry steps can be avoided by initial default settings for a particular user, who, for example, always uses a CNC-driven laser-cutting machine, or is always interested in the highest strength, most fatigue-resistant folded structure, regardless of the cost in terms of time required to cut the cut zones.

Next, fold program 38 initiates a fold line subroutine (step 305) in order to define a preferred fold geometry based upon the characteristics of sheet 32 and fold line 31. The fold program may determine the preferred fold geometry utilizing a look-up table or database 42 of predetermined fold geometries that are stored in memory 35 (step 306). In this case, the fold program will select a preferred fold geometry having a desired shape and scale (e.g., an arc set). For the purpose of the present invention, an arc set may include a set of serial co-tangent arcs that bound a strap on one side expressed in terms of start point, end point and center point for each connected arc in Cartesian coordinates. Data corresponding to the specific combinations of connecting arcs and slit ends may be stored in the form of predetermined arc sets.

Alternatively, the fold program will determine the preferred fold geometry by utilizing a fold algorithm 43 which has been stored in memory 35 (step 307). One will also appreciate that the fold program may be configured to determine the preferred fold geometry by utilizing a combination of the fold database and the fold algorithm (step 308).

The fold program may also include a detection algorithm 44 that detects (step 309) local weakness in sheet 32 and automatically modify (step 310) the preferred fold geometry. For example, a detection transducer 57 may scan sheet 32 and utilize the detection algorithm, or input detected data to the detection algorithm, to detect a hole, recess, or other local geometric discontinuity present in the sheet. The detection algorithm will automatically relocate, reshape, and/or otherwise modify the preferred fold geometry to compensate for localized weaknesses due to the discontinuity.

Once defined, the preferred fold geometry is applied to the electronic modeling of sheet 32 (step 311). One will appreciate that this may be done by producing a new electronic modeling, by modifying the existing electronic modeling, or by other suitable means. In particular, fold program 38 populates sheet 32 with a series of slits or cut zones 45 (see, e.g., FIG. 3). The fold program modifies the electronic modeling of the sheet with the series of slits 45 located on either side of fold line 31, which slits define a corresponding series of connected zones or straps 46. The slit/strap configuration of the fold geometry facilitates edge-to-face engagement and support of first and second planar portions 47 and 48 of sheet 32 during folding and once the sheet is folded about fold line 31 (see, e.g., FIG. 4, and FIGS. 8A, 8B, 10A, etc. of U.S. patent application Ser. No. 10/672,766 and related description, the entire contents of which is incorporated herein by this reference).

One will appreciate that the fold program may further be configured to feed revised bend deductions and/or bend allowances to the fold algorithm in order to continually provide empirical data for the purpose of further refining the fold algorithm.

Figure 3:
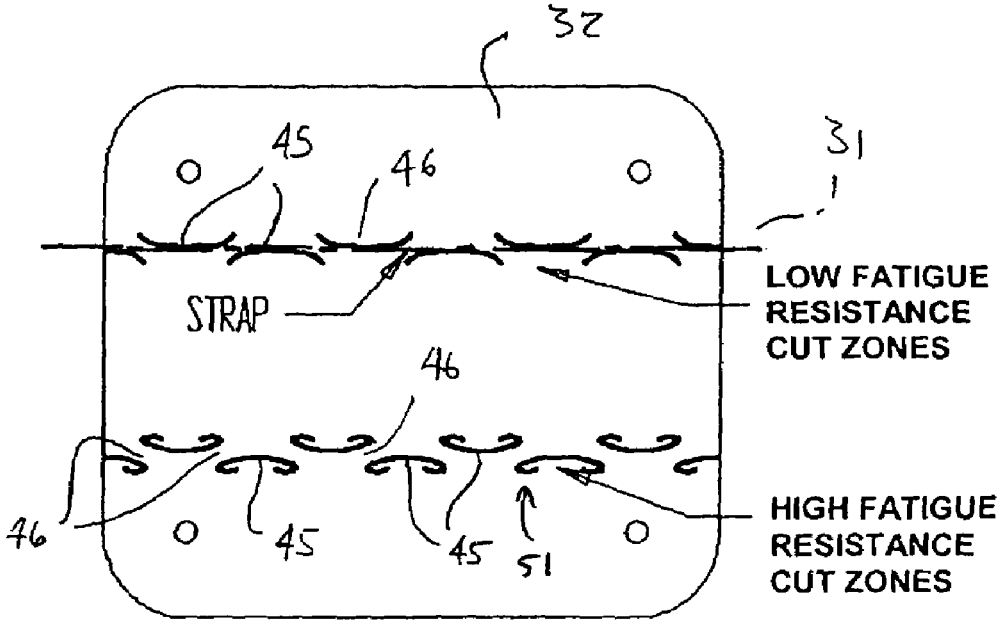
FIG. 3 is a schematic illustration of a sheet of material having an upper fold line geometry that has a relatively lower fatigue resistance and a lower fold line geometry that has a relatively higher fatigue resistance.

Preferably, the fold program is configured to allow the user to further manipulate the preferred fold geometry (step 312), as shown in FIG. 3. For example, the user may further relocate, rescale, reshape, and/or otherwise modify the preferred fold geometry, if desired, using input interface 36. In particular, the slits may be modified in order to displace, add, subtract and/or otherwise modify the straps as desired by the user. Such modifications may be performed to a 2D, unfolded model, 3D, folded electronic model, or to a model that can be partially or fully folded and unfolded as a part of the modification and design process. Moreover, the modification may be expressed as input parameters that are not visually displayed with a graphic representation of the electronic model.

Once the preferred fold geometry is applied to the electronic modeling of sheet 32, the resulting model of the sheet and fold geometry is output to display unit 39 for. visual simulation thereof (step 313).

In the event computer 33 is operably connected to a cutting machine 41, the resulting model of the sheet and fold geometry is output in a suitable format to the cutting machine (step 314) thus allowing the cutting machine to apply the preferred fold geometry to the actual sheet 32. For example, step 314 may comprise sending instructions to a CNC cutting machine that cuts slits 45 into the actual sheet 32 by suitable means including, but not limited to, laser cutting, water-jet cutting, punching, stamping, roll-forming, machining, photo-etching, chemical machining and the like.

As noted in connection with the prior related applications, processes for forming the slits which will control and precisely locate the bending of sheet material include such processes as punching, stamping, roll-forming, machining, photo-etching, chemical machining and the like. These processes are particularly well suited for lighter weight or thinner gauge material, although they also can be employed for sheet material of relatively heavy gauge. The thicker or heavier gauged materials often are more advantageously slit or grooved using laser cutting or water jet cutting equipment.

Turning now to the capabilities of the fold program, various aspects of fold geometries will now be discussed in greater detail. For the purposes of this discussion, the term "engineered fold" refers to a fold or bend that may be accomplished by bending a sheet of material along a desired fold line about which a preferred fold geometry has been applied, that is, a sheet of material upon which a series of cut zones 45 have been applied and thus a series of connected zones 46 defined. The term "brake bend" refers to a fold or bend that may be accomplished by conventional means such as using a press brake or a leaf brake.

Generally, fold program 38 may be configured to allow a user to declare or change fold line 31 of an electronic modeling of sheet 32 by several methods. For example, a user may wish to provide a sheet of material with one or more engineered folds, with one or more brake bends, or a combination thereof. Preferably, the fold program is configured to allow the user to select between engineered folds and brake bends, individually or globally. The methods by which such a fold/bend feature can be identified and subsequently changed include, but are not limited to, right mouse clicking on a face of the bend/fold feature (e.g., on the simulated fold line on the electronic modeling of the sheet), right mouse clicking on the appropriate entry in design application feature tree, and or by a navigation-type operation utilizing drop down menus commonly found in design applications and other windows-type software applications (e.g., Insert>Sheet Metal>Engineered Fold). Preferably, the user may subsequently change or reclassify the feature as desired.

Individual slits 45 which collectively make up the fold geometry may have various geometric configurations. One will appreciate that the slits are coincident with the centerline of the cut path of a cutting machine, for example, with the cut path of a CNC cutting system such as a laser-cutting machine, a water-jet cutting machine, and or other suitable means. One will also appreciate that the slits may be formed by methods other than cutting such as, but not limited to, injection molding, casting, punching and stamping.

Figure 5B:
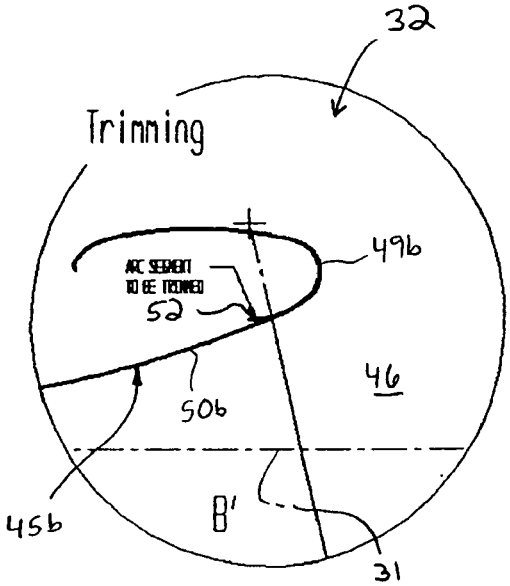
FIG. 5B is a further enlarged top plan view of the area in FIG. 5A bounded by circle 5B.

In one embodiment, curved slit 45 may comprise a substantially arcuate shape with the convex side thereof oriented toward fold line 31. Generally, the slit is a compound curve in which one or both ends of the slit have slit ends 49 interconnected in a co-tangent manner by a connecting arc 50. Generally, the slit ends have a radius of curvature that is less than that of the connecting arc, as is shown in FIG. 5B. One will appreciate that the radius of the connecting arc may vary in accordance with the present invention, and in one embodiment may be so large as to approximate a straight line.

Figure 5A:
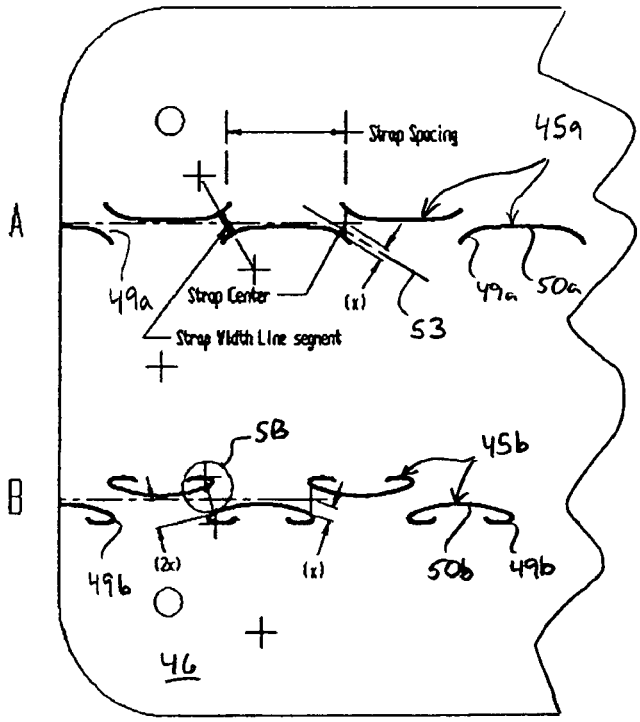
FIG. 5A is an enlarged, fragmentary top plan view of the sheet of material shown in FIG. 3.

With continued reference to FIGS. 3, 5A and 5B, the slits may be configured for relatively low fatigue resistance applications or for high fatigue resistance applications. For example, slits 45*a* are not expected to be subjected to cyclical loading or intense static loads. Accordingly, low fatigue resistant slits do not require increased stress resistance and may be formed more economically as such slits do not require substantially reduced-radii slit ends. In contrast, high fatigue resistant slits 45*b* are expected to be subjected to cyclical loading or intense static loads. Such high-fatigue slits are formed with slit ends 49*b* having radii of curvature that are substantially smaller than that of connecting arcs 50*b*. For example, cut zones of the high or low fatigue variety, as illustrated in FIG. 3, can be scaled to be wider or narrower by constructing these cut zones from a central arc that is maintained at a constant jog distance from the fold line and joined to desired slit ends stored in the fold database, which slit ends terminate the cut zone in a reduced radius manner thereby reducing geometric points of stress concentration. To widen such a cut zone, the slit ends are moved further apart and a larger radius connecting arc is set midway between the terminating arc sets at the same jog distance away from the fold line.

Preferably fold program 38 is configured for "slit trimming", that is, the process of removing an excess portion 52 of slit ends 49*b* after a connecting arc 50*b* has been made serially co-tangent with the respective slit ends, as shown in FIG. 5. For example, excess overlap of the connecting arc and slit ends that is not co-tangent (e.g., excess portion 52) is trimmed away within the electronic model or the graphical representation thereof. The advantage of storing compound curves as arc sets in a fold database is that conventional CNC cutting equipment that will affect these cuts require connected arcs to express compound curves. One will appreciate that other means may be used to generate compound-curve slit geometry, for example, splines, bitmaps, polynomials, trigonometric function and other mathematical expressions that can be parametrically scaled to adjust the shape of the cut zone at the same time that the jog is held constant, the strap width or strap density are adjusted as required and, if in a non-uniform fold condition, fold deduction is held constant along the fold. Additionally, whether the cut zone is constructed from stored segments with a connecting arc or the entire cut zone is mathematically expressed, the preferred geometry for a given material and material thickness can be related to a stored database or a finite element model that has been confirmed for the material in question.

A strap axis 53 is the virtual dimension (e.g., having no width or kerf) depiction of a connected zone or strap across fold line 31 (e.g., FIG. 5A). A plurality of predefined strap axes are provided in the fold database. The fold program determines the strap axis as wide, medium or narrow dependent upon the material and thickness of the sheet. For example, the user may input a specific thickness of the material and the fold program scales the stored, appropriate strap to the thickness of the sheet as input by the user. The scaling can be the result of empirical stored data in look-up tables (e.g., look-up table 42) or algorithms developed and confirmed by such empirical data and theoretical principles.

Figure 8:
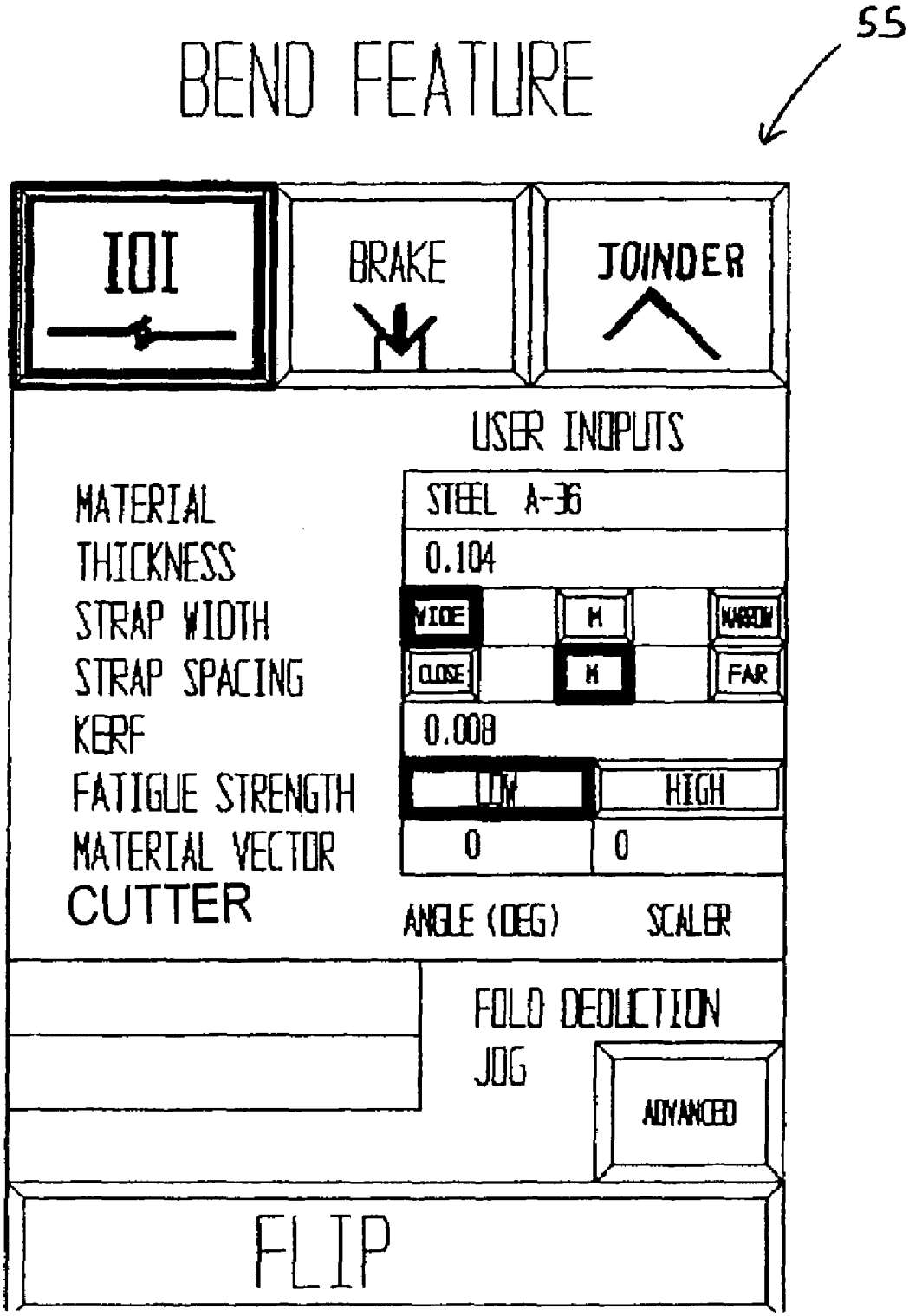
FIG. 8 is a schematic illustration of a graphical interface that a user may utilize to input various characteristics of a sheet of material to be folded.

In one embodiment, existing software spreadsheets, for example, an Excel® spreadsheet is used to organize and store the predefined fold geometries in the fold database. When the fold program is first run, fold database 42 will be loaded into memory 35 so that it can be queried as an efficient, fast look-up table. Each row in the table consists of values that are matched against user inputs from the fold program and corresponding outputs that describe a preferred fold geometry, with a constant fold deduction, that is, an analogous compensating stretch factor, interchangeable with a bend allowance, bend deduction or k factor, that is characteristic of the preferred geometry selected. With reference to FIG. 8, the input data values that may be input by the user include:

1. Material;
2. Material thickness;
3. Strap width (e.g., narrow, medium, wide);
4. Strap spacing (e.g., short, medium, long);
5. Kerf (i.e., the width of laser or water-jet cut);
6. High or low fatigue strength (e.g., the fold program may be configured to default to low);
7. Angle of material grain orientation vector (e.g., the fold program may be configured such that "0" implies an isotropic material);
8. A scalar of material grain orientation vector; and
9. Cutting apparatus.

The user supplied input parameters are matched against an "Input Match Criteria" side of the table from top to bottom. Each parameter will either require an exact numeric match or use range based match logic. For example, the user may input the following values:

1. Material=Steel A36 Cold Rolled;
2. Material Thickness=0.125 inches;
3. Strap Width=Narrow;
4. Strap Spacing=Long;
5. Kerf=0.010;
6. Fatigue Strength=Low;
7. Angle=0;
8. Scalar=0; and
9. Laser cutter.

It is noted that isotropic sheet materials have a zero value for the angle and scalar of the material, by definition. Anisotropic materials, have some non-zero value that indicates the direction and magnitude of the material grain. The fold program and attendant database of the present invention may track this material orientation vector to prevent connected zones (e.g., straps) from running parallel to the cross grain direction. This can be accomplished by changing the strap angle to a value higher or lower than what would be used in a similar isotropic material, or it can be accomplished by rotating the slits in the middle such that all connected zones run in the same direction rather than in the alternating, force-canceling manner that is customarily employed. The software program compensates for folds in anisotropic material when those folds-lines are other than parallel or perpendicular to the material vector, that is, diagonal folds relative to the grain of the material.

Optionally, the Material Value requires an exact match in the table and the supported values will be available from a pull-down list. The Material Thickness may be matched against a Low Limit Value and High Limit Value that define a range between which a match is found. The Strap Width may require an exact match, as does the Strap Spacing. The Kerf may be matched against a range of values also defined by Low and High Limits defined in the table as well as the cutting capabilities of the cutting apparatus. A Kerf Reference may be stored in the fold database with each row in the table and the actual Kerf may be compared to adjust the Fold Deduction according to a simple arithmetic formula. The High/Low Fatigue may require an exact match and constitute a switch or can cross from one family of cut zones to another to another as the fatigue requirement parameter changes. The Angle of Material Grain Orientation Vector may be matched against a range of values set by table limits.

The first row in which the set of inputs from fold program matches all the Input Match Criteria values in that row is designated a true rule and the output result is a set of data that defines the appropriate strap and fold geometry. The Output Values may include:

1. Jog (e.g., distance of the slit centerline to the fold line);
2. Fold Deduction;
3. Kerf Reference;
4. Strap Angle;
5. Arc Set.

The fold database table may establish large ranges for variables that are not sensitive to small changes and unique values or small ranges for those variables that are sensitive to small changes.

Figures 6, 7:
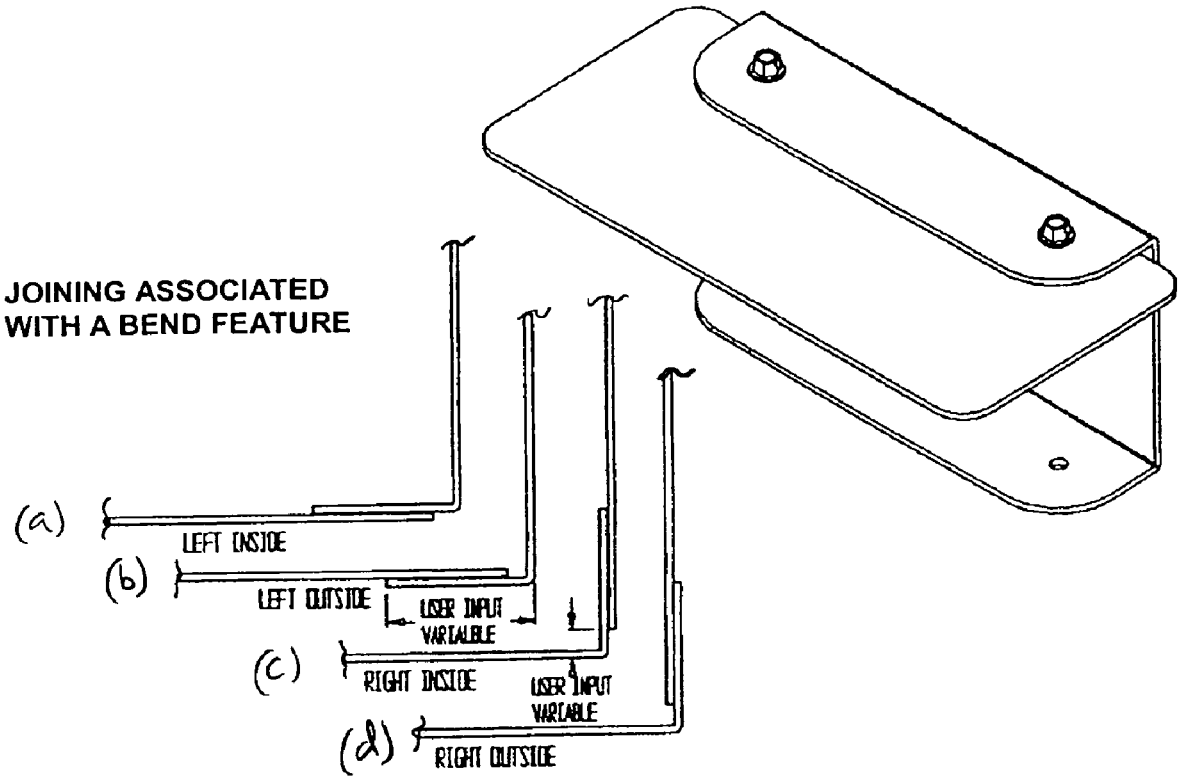
FIG. 6(*a*)-(*d*) are elevation views of exemplary joining configurations.
FIG. 7 is a top pictorial view of an assembled joining feature.

Preferably, the fold program is also configured to generate one or more "joinder features" or fastening mechanisms associated with either an engineered fold or a brake bend. A joinder feature is one that facilitates the joining or connection of two free sheet metal edges in a plane or at an angular intersection, that is, mechanically joining one planar portion of a sheet to another planar portion of that sheet or a planar portion of another sheet. For example, one form of a joinder feature is a lapped flange 54, such as those shown in FIG. 6(*a*) to FIG. 6(*d*), which may result when a sheet is folded back on itself, or when two separate sheets are joined together. The lapped flange has four forms, flange left inside, flange left outside, flange right inside, and flange right outside. Other later forms of joinder may include tabs and complimentary-shaped slots that allow for butting engagement of two or more planar portions and/or dihedral intersection of planar portions, as described in the '870 and '766 applications. For example, the joinder features may take the form of aligned holes, tabs, slots and/or other suitable fastening means. One will appreciate that such joinder features may be temporary or permanent. For example, TOGGLE-LOCK™, adhesives, adhesive strips, VELCRO®, welding, soldering, or brazing, and other known fastening methods may be used to secure two sheets together at a joinder feature.

The fold program may be provided with other editing tools to assist the user. For example, a "uniform fold" is an engineered fold generated by the fold program that has uniform strip and strap characteristics along the fold line. For example, a uniform fold will have a constant strap width and constant strap spacing along the length of the fold program. Preferably the fold program includes a "uniform fold edit flag" that provides an indication of strap editing within a uniform fold. A uniform fold may incorporate global actions performed from the bend feature control panel. Once the fold has been manipulated from the Strap Edit Control Panel 55 (e.g., FIG. 8), the flag may be set so that the editing may no longer be controlled from the Bend Feature Control Panel other than to change the classification from engineered fold to brake bend to joinder.

In operation and use, a user will first design a 3D model of a part that is to be manufactured by bending a sheet of material. For example, a user may utilize a CAD/CAM design application, such as SOLIDWORKS® 2004, to design an electronic 3D model of a channel-shaped part having shape similar to that shown in FIG. 4, but without the engineered folds of the present invention.

Some existing CAD/CAM design applications allow the user to electronically manipulate the 3D model and flatten the 3D model to provide an electronic 2D model of the single sheet of material necessary to produce the corresponding 3D part, but without the engineered folds of the present invention. Such CAD/CAM design applications will automatically determine the shape of the sheet material necessary to produce the 3D part, as well as the fold lines about which the sheet material must be folded to shape the desired 3D part.

Figure 4:
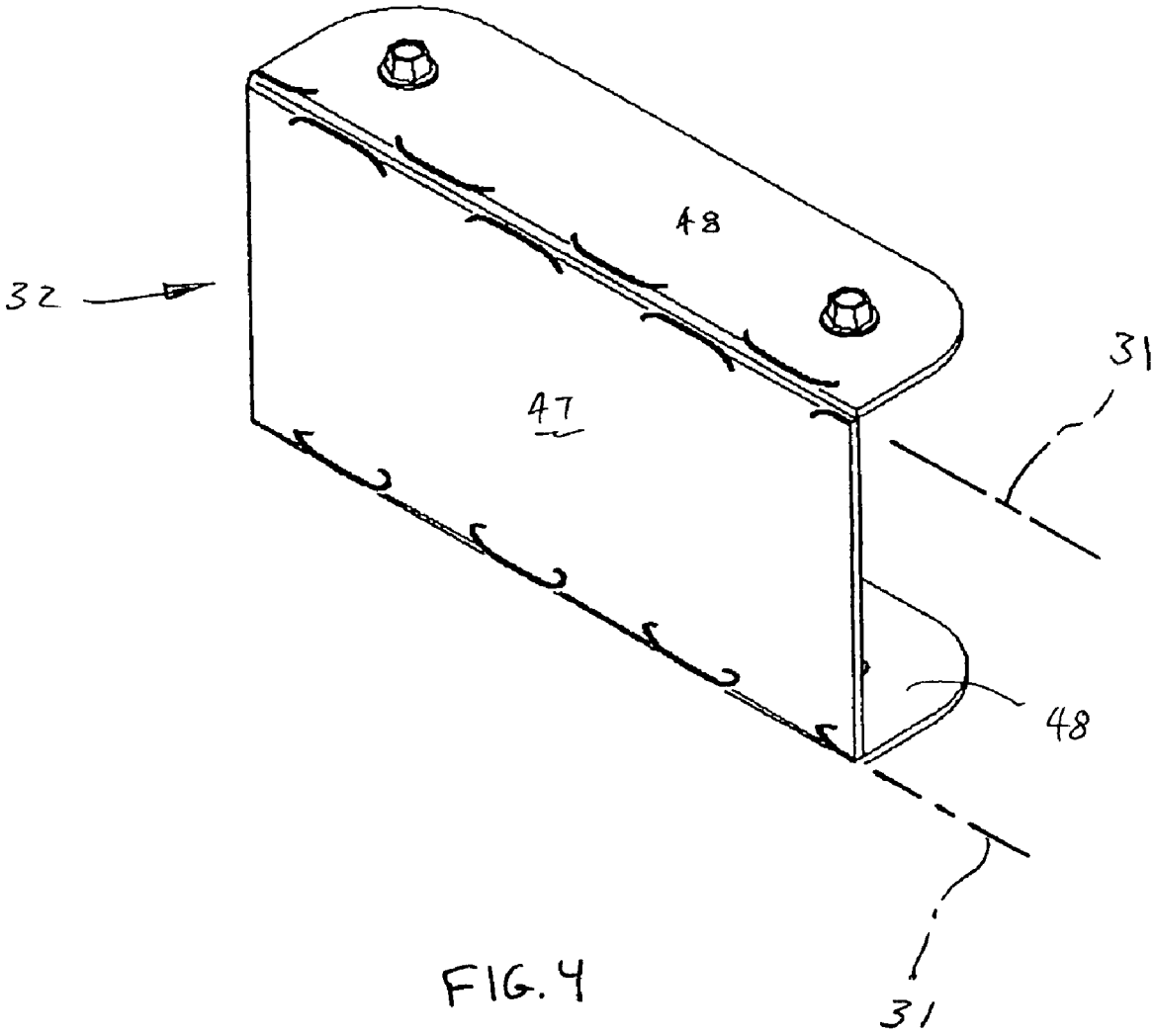
FIG. 4 is a top pictorial, illustration of the sheet of material shown in FIG. 3 after it has been bent about the two parallel fold lines.

For example, the user may utilize the CAD/CAM design application to automatically determine the geometric shape of a sheet having a shape similar to that shown in FIG. 3, which sheet may be used to produce the 3D part similar to that shown in FIG. 4, but without the engineered folds of the present invention. Furthermore, the CAD/CAM design application may automatically determine the number and location of fold lines necessary to fold the sheet of FIG. 3 into the channel-shaped part of FIG. 4, but without the engineered folds of the present invention.

The user may then utilize the computer program product of the present invention to customize the fold line in such a manner that allows bending of the sheet material along the fold line that results in a 3D part having edge-to-face engagement and support along the fold line, that is, with the engineered folds of the present invention. As noted above, the program of the present invention may be implemented as an adjunct (e.g., a plug-in) to existing CAD/CAM design application or, alternatively, be integrated into a design application, or exist as a stand-alone program.

In the event the user wishes to customize the fold line, the user may select engineered fold (e.g. "IOI") by way of strap edit control panel 55 (FIG. 8). One will appreciate that the various means may be used to facilitate the user's selections including, but not limited to, drop-down menus, dialog boxes and other suitable means.

With continued reference to FIG. 8, the user will then enter, or be prompted to enter various input data values associated with desired design criteria. For example, in the event that the user is designing a 3D part of a particular type of steel, the user may select "steel A-36" from a list of available materials such as aluminum, titanium, or other suitable materials by way of drop-down menu or other means.

Next the user may enter the material thickness, for example, "0.104" inches. Alternatively, the computer program product of the present invention may be configured to automatically calculate and/or use the material thickness based on the electronic model of the 3D part.

The user may then select the desired strap width and strap spacing. In the embodiment illustrated in FIG. 8, strap edit control panel 55 provides three choices for strap width including "wide", "medium" and "narrow", and three choices for strap spacing including "close", "medium" and "far". Strap width and strap spacing may be a function of material thickness, in which case, the user may utilize the program to automatically scale the width and/or spacing based on a predefined scale range stored in the database and/or calculated by algorithms incorporated in the program. One will appreciate that the program may be provided with a greater number of width and space choices, or may be provided with means to allow the user to input other widths and/or spacings desired by the user.

Next, the user may input the desired kerf, for example, "0.008" inches. The program may also be configured to automatically calculate a desired kerf based upon various parameters such as material type, material thickness, and/or other design considerations.

The user may then select the desired fatigue strength. In the illustrated embodiment, the user may choose between "low-fatigue" and "high fatigue". One will appreciate, however, that the program may be configured to allow the user to input a particular value or values associated with fatigue strength (e.g., modulus of elasticity, etc.) to further customize the desired strength of the fold line.

The user may select a material vector to change the angle of the cut zone(s) with respect to the fold line and/or the scaler of the cut zones. One will also appreciate that the program may be configured to allow the user to vary other characteristics of the cut zone(s) including, but not limited to, pitch, jog distance, desired shapes, etc. Strap edit control panel 55 may be configured to list or prompt for such characteristics, or the program may be configured to provide such characteristics on an "advanced" menu or dialog box.

The user may also select "flip" to avoid a discontinuity present in the sheet material adjacent the fold line. For example, the engineered fold may be "flipped" about the fold line such that the position of a cut zone above the fold line is mirrored about the fold line, and vice versa. Other means may also be provided to reconfigure cut zone positioning to avoid discontinuities.

Once the user inputs his or her selections, the program the user may review on display unit 39 an electronic 3D part modeling and/or an electronic 2D sheet modeling incorporating the customized fold line, that is, the engineered fold 9. If the user deems further modifications are desirable, the user may return to strap edit control panel 55 to edit his or her previous selections. Provided the user is satisfied with the resulting engineered fold, the user may output a 2D or 3D electronic modeling incorporating the engineered fold(s) to cutting machine 41 (FIG. 1) and/or otherwise output the modeling(s) in the form of various well-known formats including, but not limited to, .MDF, .DXF, .IGES, and/or .STEP files.

In the design of fold lines in sheet materials to effect a folded, three dimensional structure, accuracy, rigidity, and strength are useful advantages of the present invention, but so is a controlled and dramatically reduced bending force. There is a design trade-off between the bending force of the engineered fold and the ultimate strength of that fold within a closed three dimensional structure. The bending force is a product of various parameters including, but not limited to, strap density, strap with, and to some degree, strap angle relative to the fold line. If a designer wants a very strong fold then a higher amount of bending force must be tolerated resulting in high strap density and high strap width. If a designer wants low bending force and is unconcerned about the ultimate strength of the fold, then a low strap density and narrow strap width are employed. Intermediate values can result in intermediate results. The fold program may allow the user to achieve these trade-offs by directly specifying strap width and strap density and/or other target parameters for strength or folding force would result in the strap width and strap density being driven values.

Traditional bending is able to hold the bend angle because of the high bending force required to take the material through plastic deformation. The present invention may take advantage of a lower folding force and might not be expected to fix the rotational angle of the engineered fold. However, a closed three dimensional structure fixes the rotational angle through the intersection of interlocking planes and the overall structure is both rigid and strong in the same manner that a pin truss makes maximum use of the materials employed. When opportunities for restricting all rotational degrees of freedom are unavailable, a system in accordance with the present invention may either mix together engineered folds with traditionally bent folds or indicate that the engineered fold may be subsequently strengthened by a fusing or bracing step.

Additionally, the software program of the present invention and the attendant database of preferred slit geometry parameter, graphics, and/or mathematically expressed compound curves seek to maintain a substantially constant engineered fold deduction along any given fold. This may be important when a uniform fold is edited and manipulated that result in subsection with strap densities or strap width that differ from the original uniform fold. The jog, most preferably, is also held substantially constant along any given fold, so the primary variable that can be changed to hold the engineered fold deduction constant is the shape of the slit that defines the intervening connected zone. The slit shape cannot be expressed as a single parameter. One of the functions of present invention is to assist the designer, in the process of modifying a uniform fold, to optionally restrict the fold modifications to those that have been predetermined, empirically or through finite element modeling, to have local engineered fold deduction values that are compatible with the rest of the fold. Otherwise a physically folded sheet of material may rotate slightly relative to the electronic model from which it was designed and the overall three dimensional accuracy and rigidity would suffer.

For convenience in explanation and accurate definition in the appended claims, the terms "up" or "upper", "down" or "lower", "left" and "right", "inside" and "outside" are used to describe features of the present invention with reference to the positions of such features as displayed in the figures.

In many respects the modifications of the various figures resemble those of preceding modifications and the same reference numerals followed by subscripts "a", "b", "c", and "d" designate corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A method of designing a desired told line for a non-crushable sheet of material comprising the steps of:

defining said desired fold line in a parent plane on a drawing system; and populating said fold line with a fold geometry including a series of cut zones that define a series of connected zones configured and positioned relative to said fold line whereby upon folding said material along said fold fine produces edge-to-face engagement of said material on opposite sides of the cut zones.

2. The method as set forth in claim 1 further comprising manipulating said cut zones to define said connected zones that are along said fold line so as to enable said edge-to-face engagement upon folding of said material along said fold line, wherein said manipulating is selected from the group of locating, scaling, shaping, and combinations thereof.

3. The method as set forth in claim 2 further comprising further manipulating at least one of said cut zones to adjust at least one of said connected zones, wherein said further manipulating is selected from the group of relocating, rescaling, reshaping, and combinations thereof, and wherein said adjusting is selected from the group of displacing, adding, subtracting, and combinations thereof.

4. The method as set forth in claim 3 further comprising:

detecting weaknesses in said parent plane; and manipulating at least one of said connected zones to further adjust at least one of said connected zones based on localized fold geometry adjacent said weaknesses, wherein said manipulating said connected zone is selected from the group of relocating, rescaling, reshaping, and combinations thereof, and wherein said further adjusting is selected from displacing, adding, subtracting, and combinations thereof.

5. The method as set forth in claim 1 wherein said populating step defines said cut zones and connected zones to resist stress concentration, fatigue, or fracture initiation upon folding said material along said fold line.

6. The method as set forth in claim 1 further comprising defining said fold geometry based upon at least one parameter selected from the group of material, material thickness, strap width, strap density, kerf, fatigue strength, and angle of material orientation.

7. The method as set forth in claim 1 wherein said method is implemented as an adjunct to one of a CAD/CAM system having fold and unfold capabilities.

8. The method as set forth in claim 7 further comprising providing a visualization on said CAD/CAM system that displays said cut zones and said connected zones geometry as populated along said fold line.

9. The method as set forth in claim 1 wherein said method is implemented integral with a CAD/CAM system having fold and unfold capabilities.

10. The method as set forth in claim 1 further comprising designing a creased sheet-material product including creased features, wherein said cut zones and said connected zones are superimposed upon the creased features.

11. A method of designing a desired fold line for a non-crushable sheet of material comprising the steps of:

storing a plurality of cut zone configurations and connected zone configurations having differing physical characteristics;

defining a desired fold line in a parent plane on a drawing system;

selecting a preferred zone which has a desired shape and scale, wherein said zone comprises a member from the group of a cut zone, a connected zone, and combinations thereof;

locating a preferred fold geometry along said fold line, said preferred fold geometry including said selected zone; and manipulating said preferred fold geometry to adjust at least one of said connected zones, whereby upon folding said material along said fold line produces edge-to-face engagement of said material on opposite sides of said cut zones, wherein said manipulating is selected from the group of relocating, rescaling, reshaping, and combinations thereof, and wherein said adjusting is selected from the group of displacing, adding, subtracting, and combinations thereof.

12. The method as set forth in claim 11 further comprising providing a fastening mechanism for permitting connection of a first plane of said material with a second plane lapped with said first plane in association with said fold line.

13. The method as set forth in claim 12 wherein said fastening mechanism is selected from the group of aligned holes, tabs, slots and combination thereof.

14. A computer program product in a computer-readable medium for use in a data processing system, which when executed on a computer, causes the computer to design a desired fold line for a non-crushable sheet of material, the computer program product comprising:

instructions for defining said desired fold line in a parent plane on a drawing system;

instructions for populating said fold line with a fold geometry including a series of cut zones that define a series of connected zones configured and positioned relative to said fold line whereby upon folding said material along said fold line produces edge-to-face engagement of said material on opposite sides of the cut zones; and instructions to store information related to said fold line in the computer-readable medium.

15. The computer program product as set forth in claim 14 further comprising instructions for manipulating said cut zones to define said connected zones that are along said fold line so as to enable said edge-to-face engagement upon folding of said material along said fold line, wherein said manipulating is selected from the group of locating, scaling, shaping, and combinations thereof.

16. The computer program product as set forth in claim 15 further comprising instructions for further manipulating at least one of said cut zones to adjust at least one of said connected zones, wherein said further manipulating is selected from the group of relocating, rescaling, reshaping, and combinations thereof, and wherein said adjusting is selected from the group of displacing, adding, subtracting, and combinations thereof.

17. The computer program product as set forth in claim 16 further comprising:

instructions for detecting weaknesses in said parent plane; and instructions for manipulating at least one of said connected zones to further adjust at least one of said connected zones based on localized fold geometry adjacent said weaknesses, wherein said manipulating said connected zone is selected from the group of relocating, rescaling, reshaping, and combinations thereof, and wherein said further adjusting is selected from the group of displacing, adding, subtracting, and combinations thereof.

18. The computer program product as set forth in claim 14 wherein said instructions for populating define said cut zones and connected zones to resist stress concentration and fracture initiation upon folding said material along said fold line.

19. The computer program product as set forth in claim 14 further comprising instructions for defining said fold geometry based upon at least one parameter selected from the group of material, material thickness, strap width, strap density, kerf, fatigue strength, and angle of material orientation.

20. The computer program product as set forth in claim 14 wherein said computer program product is configured for installation with a CAD/CAM system having fold and unfold capabilities.

21. The computer program product as set forth in claim 20 further comprising instructions for providing a visualization on said CAD/CAM system that displays said cut zones and said connected zones geometry as populated along said fold line.

22. The computer program product as set forth in claim 14 wherein said computer program product includes a CAD/CAM application having fold and unfold capabilities.

23. The computer program product as set forth in claim 14 further comprising instructions for designing a creased sheet-material product including creased features, wherein said cut zones and said connected zones are superimposed upon desired creased features.

24. A computer program product in a computer-readable medium for use in a data processing system, which when executed on a computer, causes the computer to design a desired fold line for a non-crushable sheet of material, said computer program product comprising:

instructions for storing a plurality of cut zone configurations and connected zone configurations having differing physical characteristics in a computer-readable medium;

instructions for defining a desired fold line in a parent plane on a drawing system;

instructions for selecting a preferred zone which has a desired shape and scale, wherein said preferred zone comprises a member selected from the group of a cut zone, a connected zone, or combinations thereof;

instructions for locating a preferred fold geometry along said fold line, said preferred fold geometry including said selected zone;

instructions for manipulating said preferred fold geometry to adjust at least one of said connected zones, whereby upon folding said material along said fold line produces edge-to-face engagement of said material on opposite sides of said cut zones, wherein said manipulating is selected from the group of relocating, rescaling, reshaping, and combinations thereof;

instructions to store information related to the manipulated fold geometry in the computer-readable medium, and wherein said adjusting is selected from the group of displacing, adding, subtracting, and combinations thereof.

25. The computer program product as set forth in claim 24 further comprising instructions for providing a fastening mechanism for permitting connection of a first plane of said material with a second plane lapped with said first plane in association with said fold line.

26. The computer program product as set forth in claim 25 wherein said fastening mechanism is selected from the group of aligned holes, tabs, slots and combination thereof.

27. A data processing system for designing a desired fold line for a non-crushable sheet of material comprising:

input means for defining said desired fold line in a parent plane on a drawing system; and computing means for populating said fold line with a fold geometry including a series of cut zones that define a series of connected zones configured and positioned relative to said fold line whereby upon folding said material along said fold line produces edge-to-face engagement of said material on opposite sides of the cut zones.

28. The system as set forth in claim 27 wherein said computing means manipulates said cut zones to define said connected zones that are along said fold line so as to enable said edge-to-face engagement upon folding of said material along said fold line, wherein said manipulating is selected from the group of locating, scaling, shaping, and combinations thereof.

29. The system as set forth in claim 28 wherein said computing means further manipulates at least one of said cut zones to adjust at least one of said connected zones, wherein said further manipulating selected from the group of relocating, rescaling, reshaping, and combinations thereof, wherein said adjusting is selected from the group of displacing, adding, subtracting, and combinations thereof.

30. The system as set forth in claim 29 wherein said computing means detects weaknesses in said parent plane and manipulates at least one of said connected zones to further adjust at least one of said connected zones based on localized fold geometry adjacent said weaknesses, wherein said manipulating said connected zone is selected from the group of relocating, rescaling, reshaping, and combinations thereof, and wherein said further adjusting is selected from the group of displacing, adding, subtracting, and combinations thereof.

31. The system as set forth in claim 27 wherein said computing means defines said cut zones and connected zones to resist stress concentration and fracture initiation upon folding said material along said fold line.

32. The system as set forth in claim 27 wherein said computing means defines said fold geometry based upon at least one parameter selected from the group of material, material thickness, strap width, strap density, kerf, fatigue strength, and angle of material orientation.

33. The system as set forth in claim 27 further comprises memory means storing a plurality of predetermined fold geometries based upon at least one parameter selected from the group of material, material thickness, strap width, strap density, kerf, fatigue strength, and angle of material orientation, wherein said computing means selects one of said predetermined fold geometries.

34. The system as set forth in claim 27 wherein said system further comprises a CAD/CAM system having fold and unfold capabilities.

35. The system as set forth in claim 34 further comprising display means for providing a visualization on said CAD/CAM system that displays said cut zones and said connected zones geometry as populated along said fold line.

36. The system as set forth in claim 27 wherein said system is used in combination with a CAD/CAM system having fold and unfold capabilities.

37. The system as set forth in claim 27 wherein said system is configured for designing a creased sheet-material product including creased features, wherein said computing means superimposes said cut zones and said connected zones upon the creased features.

38. A system for designing a desired fold line for a non-crushable sheet of material comprising:

storage means for storing a plurality of cut zone configurations and connected zone configurations having differing physical characteristics;

input means for defining a desired fold line in a parent plane on a drawing system;

computing means for selecting a preferred zone which has a desired shape and scale, wherein said zone comprises a member selected from the group of a cut zone, a connected zone, and combinations thereof, wherein said computing means locates a preferred fold geometry along said fold line, said preferred fold geometry including said selected zone, and wherein said computing means manipulates said preferred fold geometry to adjust at least one of said connected zones, whereby upon folding said material along said fold line produces edge-to-face engagement of said material on opposite sides of said cut zones, wherein said manipulating is selected from the group of relocating, rescaling, reshaping, and combinations thereof, and wherein said adjusting is selected from the group of displacing, adding, subtracting, and combinations thereof.

39. The system as set forth in claim 38 wherein said computing means is configured to design a fastening mechanism for permitting connection of a first plane of said material with a second plane lapped with said first plane in association with said fold line.

40. The system as set forth in claim 39 wherein said fastening mechanism is selected from the group of aligned holes, tabs, slots and combination thereof.

* * * * *

UNITED STATES PATENT AND TRADEMARK OFFICE

CERTIFICATE OF CORRECTION

PATENT NO. : 7,440,874 B2
APPLICATION NO. : 10/821818
DATED : October 21, 2008
INVENTOR(S) : Max W. Durney et al.

It is certified that error appears in the above-identified patent and that said Letters Patent is hereby corrected as shown below:

In claim 1, col. 17, line 37, change “told” to --fold--.

Signed and Sealed this

Fourteenth Day of July, 2009

JOHN DOLL
*Acting Director of the United States Patent and Trademark Office*